US008668521B2

(12) United States Patent
Sasaki

(10) Patent No.: US 8,668,521 B2
(45) Date of Patent: Mar. 11, 2014

(54) COAXIAL CONNECTOR

(71) Applicant: Hosiden Corporation, Osaka (JP)

(72) Inventor: Daisuke Sasaki, Osaka (JP)

(73) Assignee: Hosiden Corporation, Osaka (JP)

( * ) Notice: Subject to any disclaimer, the term of this patent is extended or adjusted under 35 U.S.C. 154(b) by 0 days.

(21) Appl. No.: 13/720,122

(22) Filed: Dec. 19, 2012

(65) Prior Publication Data

US 2013/0196540 A1 Aug. 1, 2013

(30) Foreign Application Priority Data

Jan. 27, 2012 (JP) ..... 2012-015012

(51) Int. Cl.
*H01R 9/05* (2006.01)

(52) U.S. Cl.
USPC ..... 439/582

(58) Field of Classification Search
USPC ..... 439/582
See application file for complete search history.

(56) References Cited

U.S. PATENT DOCUMENTS 5,482,475 A * 1/1996 Kawaguchi ..... 439/394
7,938,681 B2 * 5/2011 Lee et al. ..... 439/582
2001/0008816 A1 7/2001 Ko
2002/0187660 A1 12/2002 Obayashi
2010/0062639 A1 3/2010 Kohnishi et al.
2010/0087091 A1 4/2010 Chen

FOREIGN PATENT DOCUMENTS

JP 2005-032620 2/2005
JP 4148339 9/2008

OTHER PUBLICATIONS

Extended European Search Report issued May 2, 2013 for corresponding European patent application No. 12195770.8.

* cited by examiner

*Primary Examiner* — Phuong Dinh
(74) *Attorney, Agent, or Firm* — Greenblum & Bernstein, P.L.C.

(57) ABSTRACT

A contact is formed of paired contact pieces, a coupling part coupling the contact pieces, and a connecting part extended from the coupling part, and the connecting part has a plate surface lowered by one step from the coupling part in a direction in which the contact pieces project. A body includes a body main structure, a body extension part mounting thereon the connecting part, and a body inner-lid part projected from the body extension part and to be bent. A shell includes a shell main body, a shell extension part supporting the body extension part, a shell inner-lid part projected from a side wall of the shell extension part, and a shell outer-lid part. A central conductor of a coaxial cable is interposed between the body inner-lid part bent with the shell inner-lid part and the connecting part, thereby being connected to the connecting part.

6 Claims, 7 Drawing Sheets

COAXIAL CONNECTOR

TECHNICAL FIELD

The present invention relates to a coaxial connector for use in a small-sized electronic device or the like.

BACKGROUND ART

Many coaxial cables are used as inner wirings of small-sized electronic devices such as portable phones, smart phones, tablet PCs and small-sized game machines. For connection of these coaxial cables, a coaxial connector is used.

FIG. 7 to FIG. 9 depict the structure described in Japanese Registered Patent No. 4148339 as a conventional example of a coaxial connector of this type. A coaxial connector 10 is configured to include, as depicted in FIG. 7, a connection terminal 11 to be connected to a central conductor 21 of a coaxial cable 20 and a metal-made shell 13 supporting the connection terminal 11 via an insulating part 12.

The connection terminal 11 is configured to include, as depicted in FIG. 8A and FIG. 8B, paired contacts 11*a* and 11*b* formed by bending a metal-made leaf spring in an approximately V shape and paired engaging tongue pieces 11*c* formed as being extended from both side edges of one contact 11*a*. The paired engaging tongue pieces 11*c* hold a contact part of the counterpart connector.

The insulating part 12 is molded of flexible insulating resin, and is configured to include an insulating part main body 12*a* supporting one contact 11*a* of the connection terminal 11 with one surface and an insulating bending part 12*b* formed to extend from one end of the insulating part main body 12*a* to a side of the other contact 11*b* opposite from the contact 11*a* and to be bent toward the insulating part main body 12*a* at the time of connection with the coaxial cable.

The shell 13 includes a shell main body 13*a* supporting the insulating part main body 12*a* of the insulating part 12, a shell bending part 13*b* provided alongside of the insulating bending part 12*b* of the insulating part 12 and to be bent together with the insulating bending part 12*b* at the time of connection with the coaxial cable, and paired first engaging tongue pieces 13*c* formed on both sides of the shell bending part 13*b* in a width direction. Furthermore, on both sides of the shell bending part 13*b* in the width direction, paired second engaging tongue pieces 13*d* and paired third engaging tongue pieces 13*e* are formed.

In general, the coaxial cable 20 has a structure in which an insulator 22, an outer conductor 23, and an outer sheath 24 are sequentially arranged around the central conductor 21. When the coaxial cable 20 is connected to the coaxial connector 10, as depicted in FIG. 7, the outer conductor 23, the insulator 22, and the central conductor 21 are each partially exposed.

The coaxial cable 20 is connected to the coaxial connector 10 by placing the central conductor 21 of the coaxial cable 20 between the contacts 11*a* and 11*b* and simultaneously bending the shell bending part 13*b* and the insulating bending part 12*b* toward the shell main body 13*a* and the insulating part main body 12*a*, respectively. With this, the contact 11*b* of the connection terminal 11 is pressed to be bent to a contact 11*a* side, and the central conductor 21 is held between the contacts 11*a* and 11*b*, thereby causing the central conductor 21 and the connection terminal 11 to be electrically connected to each other.

The paired first engaging tongue pieces 13*c* provided to the shell bending part 13*b* are pressed inwardly to each other to be bent to fall down and, as depicted in FIG. 9, are engaged around the shell main body 13*a* and the insulating part main body 12*a* at a portion where the insulator 22 and the central conductor 21 of the coaxial cable 20 are exposed. With this, a state in which the connection terminal 11 is holding the central conductor 21 is kept, that is, an electrical connection state is kept.

Note that the paired second engaging tongue pieces 13*d* and the paired third engaging tongue pieces 13*e* provided to the shell bending part 13*b* are also each pressed and bent inwardly to be engaged around the outer conductor 23 and the outer sheath 24 of the coaxial cable 20 as depicted in FIG. 9. With these second and third engaging tongue pieces 13*d* and 13*e*, the connection state between the coaxial cable 20 and the coaxial connector 10 is more strongly kept.

Meanwhile, in the coaxial connector of this type, reductions in size and profile are demanded, with reductions in size and thickness of electronic devices for use. In particular, a reduction in profile has been strongly demanded these days.

SUMMARY OF THE INVENTION

In view of these circumstances described above, an object of the present invention is to provide a coaxial connector allowing a reduction in profile more than ever before.

According to the present invention, in a coaxial connector including a contact to be connected to a central conductor of a coaxial cable, a resin-made body for accommodating the contact, and a metal-made shell for covering the body accommodating the contact, the contact is formed of a plate-shaped coupling part, paired contact pieces to be in contact with a counterpart connector, the paired contact pieces extending from two opposite side edges of the coupling part so as to face each other, and a connecting part formed to extend from another one side edge of the coupling part to support the central conductor, and the connecting part has a plate surface lowered by one step from a plate surface of the coupling part in a direction in which the contact pieces project, the body includes a body main structure having an accommodation hole for accommodating the paired contact pieces and an accommodating part for accommodating the coupling part, a body extension part formed to extend from the body main structure to have the connecting part mounted and supported thereon, and a body inner-lid part provided to project from at least one side end of the body extension part along an extending direction and to be bent on the connecting part, the shell includes a shell main body supporting the body main structure, a shell extension part formed to extend from the shell main body to support the body extension part, a shell inner-lid part provided to project from one side end of the shell extension part along an extending direction and to be bent on the body inner-lid part, and a shell outer-lid part provided to project on the shell main body and to be bent, the central conductor is configured to be interposed between the body inner-lid part bent with bending of the shell inner-lid part and the connecting part to be connected to the connecting part, the shell main body and the shell extension part are covered with the bent shell outer-lid part, and the shell outer-lid part is provided with swage pieces for swaging a circumference of a portion of the shell extension part to which the central conductor is to be connected.

EFFECTS OF THE INVENTION

According to the present invention, the central conductor of the coaxial cable is connected to the contact not on the back side of the coupling part where the contact pieces of the contact for the counterpart connector project but on the connecting part formed to extend from the coupling part and having a plate surface lowered by one step from the coupling part in a direction in which the contact pieces project. Thus, in comparison with a conventional structure in which the central conductor is connected to the contact on the back surface of a portion where the contact pieces (the engaging tongue pieces) for the counterpart connector are positioned, a reduction in profile of the coaxial connector can be achieved.

In addition, since a soldering operation is not required for connecting the central conductor and the contact, the connecting operation can be simplified.

DETAILED DESCRIPTION OF THE EMBODIMENTS

Embodiments of the present invention are described below with reference to the drawings.

Figure 1A:
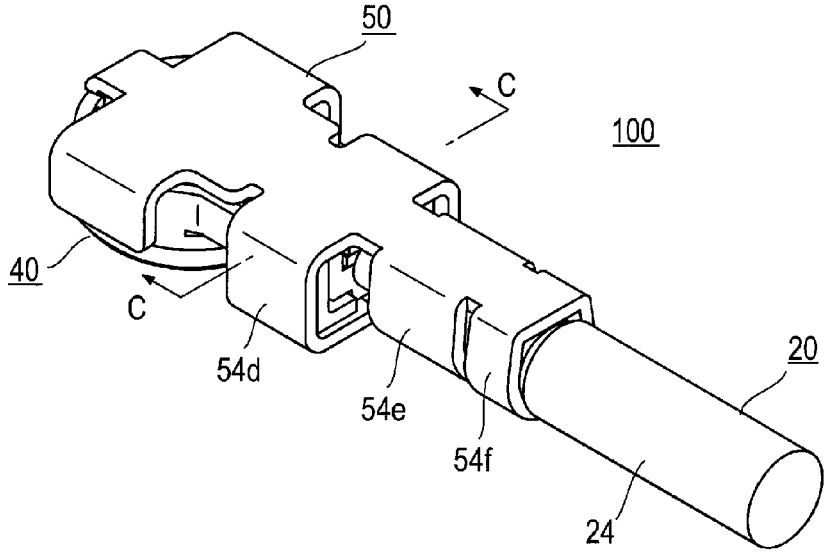
FIG. 1A is a perspective view of a coaxial connector according to an embodiment of the present invention to which a coaxial cable has been connected.
Figure 1B:
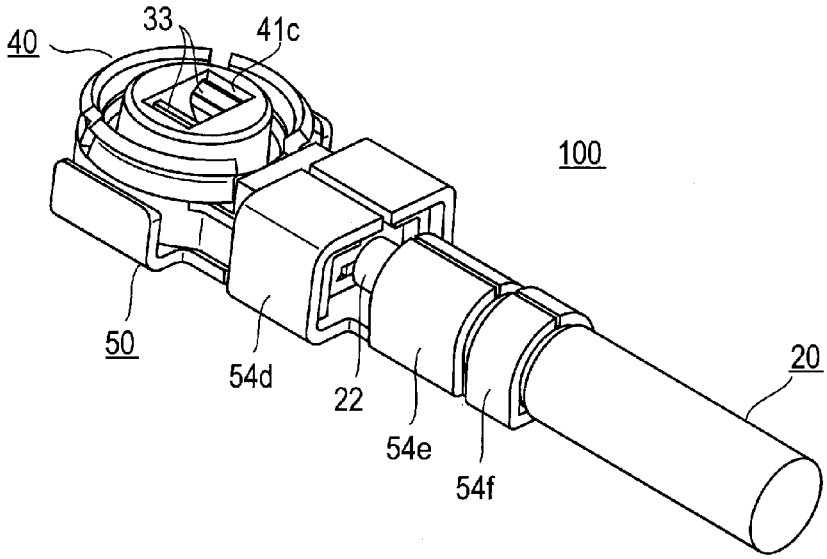
FIG. 1B is a perspective view of the coaxial connector in FIG. 1A viewed from the bottom.
Figure 2:
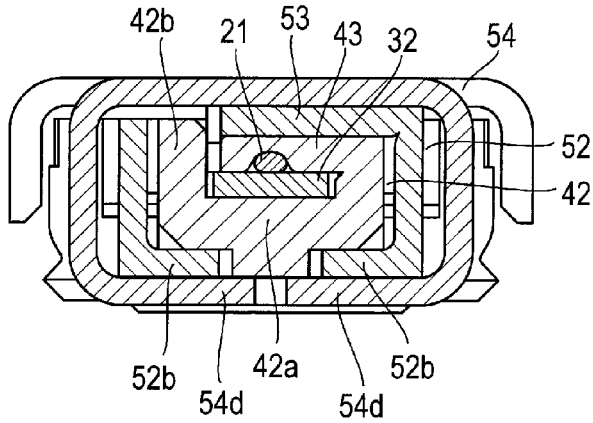
FIG. 2 is an enlarged sectional view along a C-C line in FIG. 1A.
Figure 3:
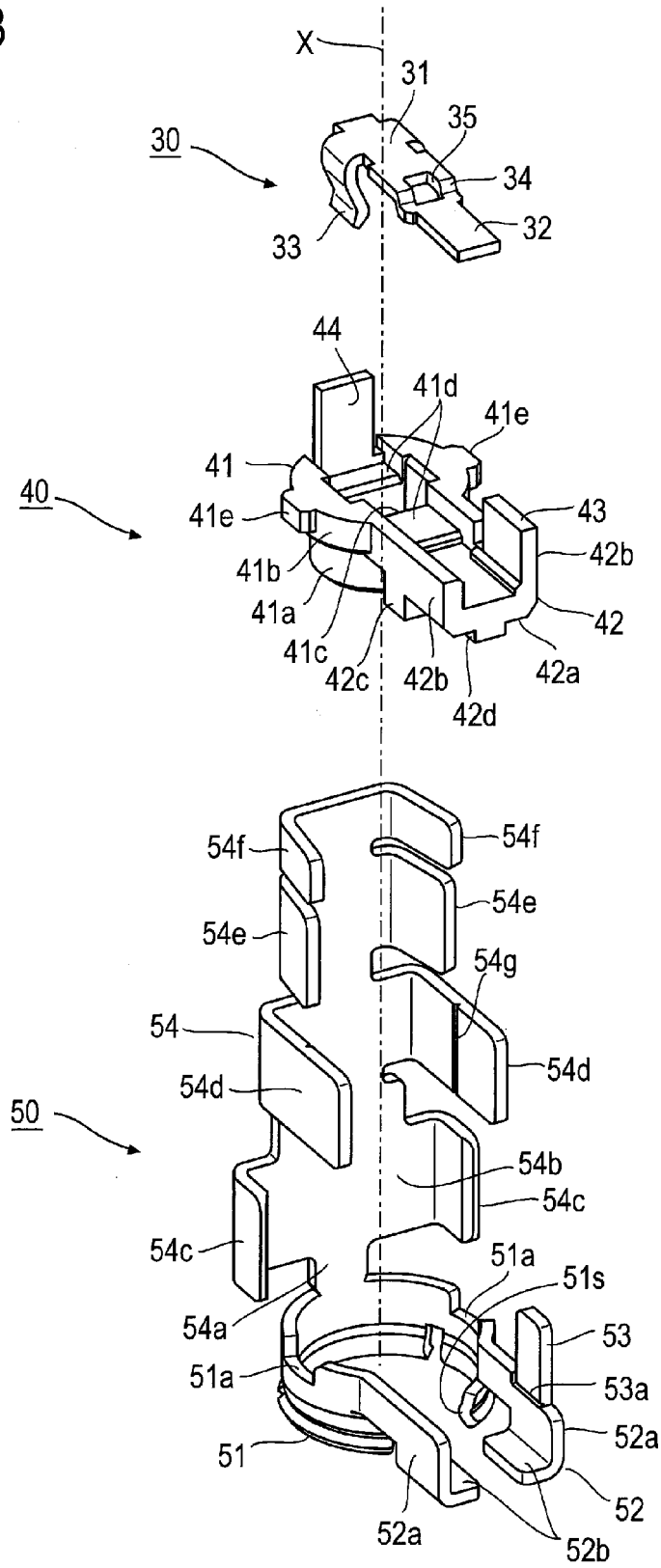
FIG. 3 is an exploded perspective view of the coaxial connector depicted in FIG. 1A and FIG. 1B.
Figure 4:
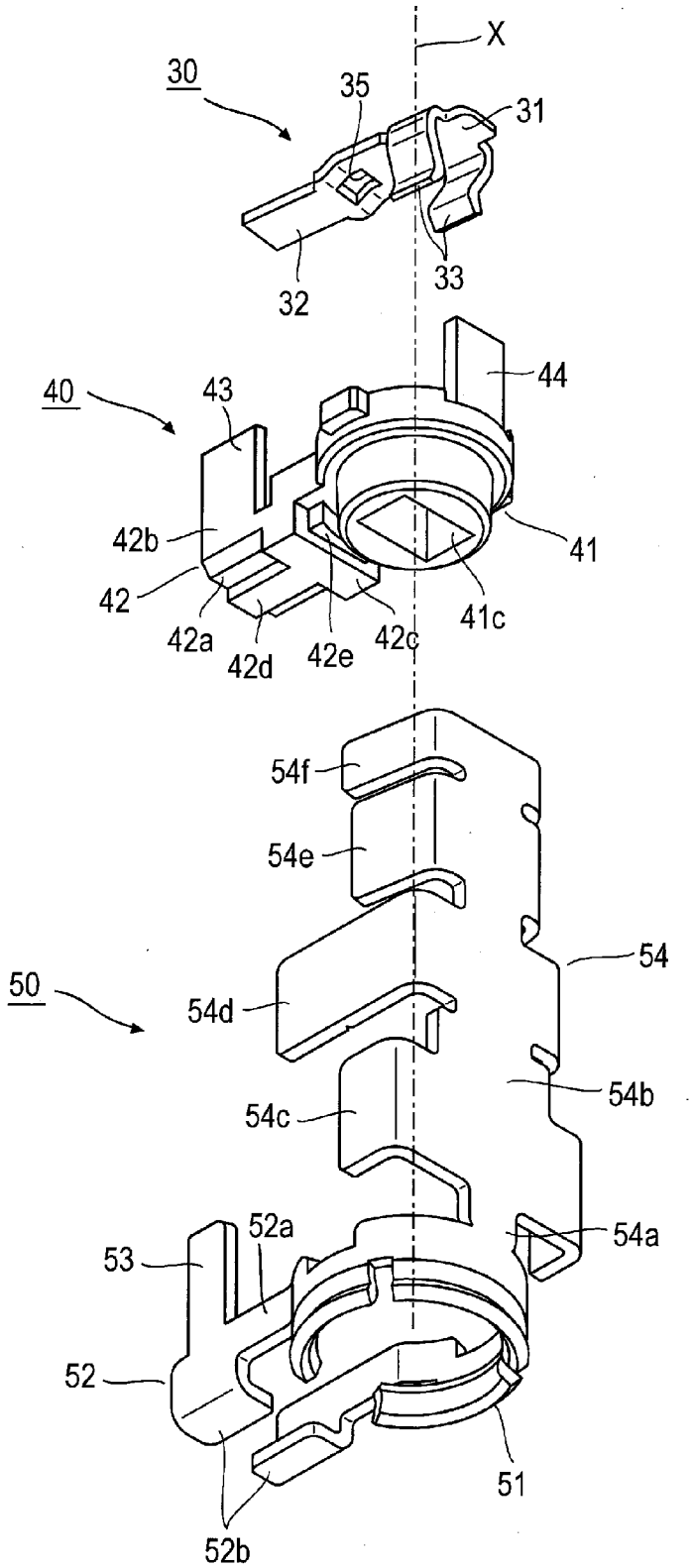
FIG. 4 is an exploded perspective view of the coaxial connector depicted in FIG. 1A and FIG. 1B viewed from a direction different from that of FIG. 3.

FIG. 1A and FIG. 1B depict outer views of a coaxial connector according to an embodiment of the present invention to which a coaxial cable has been connected, and FIG. 2 depicts its sectional structure. Also, FIG. 3 and FIG. 4 depict the coaxial connector depicted in FIG. 1A and FIG. 1B disassembled to each components before assembling and placed in a center axis X direction. First, the structure of each component is described with reference to FIG. 3 and FIG. 4.

A coaxial connector 100 is configured to include a contact 30, a body 40 made of insulating resin, and a metal-made shell 50.

The contact 30 includes a coupling part 31 in a flat plate shape, a connecting part 32 formed to extend from the coupling part 31 in a longitudinal direction of the coupling part 31, and paired contact pieces 33 having inner side surfaces formed to project from both side edges of the coupling part 31 to face each other. A plate surface of the connecting part 32 in a flat plate shape is lowered by one step from a plate surface of the coupling part 31 in a direction in which the contact pieces 33 project. Note that the coupling part 31 and the connecting part 32 form a step part 34 therebetween, where a positioning hole 35 is formed in this example.

The body 40 includes a body main structure 41, a body extension part 42, a body inner-lid part 43, and a body bending part 44. The body main structure 41 has an approximately cylindrical shape, and coaxially has a small diameter part 41*a* positioned on a lower side and a large diameter part 41*b* positioned on an upper side. At the center of the body main structure 41, a rectangular accommodation hole 41*c* is formed so as to penetrate therethrough. On an upper surface of the large diameter part 41*b*, an accommodating part 41*d* is formed in a recessed groove shape, with facing sides each communicating to the accommodation hole 41*c*. Note that projections 41*e* are provided to project at positions forming 180 degrees on an outer circumferential surface of the large diameter part 41*b*.

The body extension part 42 is formed to be extended from the large diameter part 41*b* of the body main structure 41 in a diameter direction, and includes a bottom plate part 42*a* and paired side walls 42*b* facing each other and extended from both end edges in a width direction at the right angle with respect to the bottom plate part 42*a*. The bottom plate part 42*a* is positioned on an extension of the accommodating part 41*d* formed in the body main structure 41 in a recessed groove shape, and has an upper surface positioned by one step lower than the bottom surface of the recessed groove formed in the accommodating part 41*d*.

On a lower surface of the bottom plate part 42*a* of the body extension part 42, an elongated protrusion 42*c* extending in a width direction is formed. Furthermore, an elongated protrusion 42*d* is formed from the center part of the elongated protrusion 42*c* toward an extension end of the body extension part 42. Note that a protrusion 42*e* is formed on a surface of the elongated protrusion 42*c* facing the body main structure 41.

One side wall 42*b* of the body extension part 42 has a large diameter part 41*b* side integrally coupled to a side surface of the large diameter part 41*b*, and has an upper end face flush with an upper end face of the large diameter part 41*b*. The other side wall 42*b* is also integrally coupled to the large diameter part 41*b*, and has an upper end face having a portion up to an intermediate portion in an extending direction flush with the upper end face of the large diameter part 41*b* and having a portion outside the intermediate portion in a diameter direction higher than the upper end face of the large diameter part 41*b* in the center axis X direction. In the intermediate portion, the side wall 42*b* has a notch formed therein from the upper end face to reach the bottom plate part 42*a*. A portion of the side wall 42*b* projecting from the upper end face of the large diameter part 41*b* forms the body inner-lid part 43. The body inner-lid part 43 is in a quadrate plate shape, a base part of which adjacent to the bottom plate part 42*a* has a large thickness.

The body bending part 44 is formed on a side of the large diameter part 41*b* diametrically opposite to a side where the body extension part 42 is formed to extend, projecting from a surface of the accommodating part 41*d* in the center axis X direction. As with the body inner-lid part 43, the body bending part 44 is in a quadrate plate shape.

The shell 50 includes a shell main body 51, a shell extension part 52, a shell inner-lid part 53, and a shell outer-lid part 54. The shell main body 51 is in a cylindrical shape, and has paired notches 51*a* at an upper end in the center axis X direction formed at positions forming 180 degrees to each other. Note that a lower end side of the shell main body 51 has a shape necessary to engage with the counterpart connector.

The shell main body 51 has an axial cutout slit 51*s* in a circumferential portion of the cylindrical shape thereof. From both ends of this notched shell main body 51 in a circumferential direction, the paired side walls 52*a* are extended to project in a right angle direction with respect to the center axis X. The paired side walls 52*a* together constitute the shell extension part 52 extending from the shell main body 51, and these side walls 52*a* are each provided at its lower end on a tip side with a support part 52*b* formed to be bent to project inwardly.

The shell inner-lid part 53 is formed to project and extend from an upper end of one side wall 52*a* of the shell extension part 52 in the center axis X direction. The shell inner-lid part 53 is in a quadrate plate shape.

The shell outer-lid part 54 is formed on a side diametrically opposite from a side where the shell extension part 52 is formed to extend, extending from the upper end of the shell main body 51 in the center axis X direction. The shell outer-lid part 54 has a narrow base end part 54*a*. A wide trunk part 54*b* continued from the base end part 54*a* of the shell outer-lid part 54 along an extending direction have both sides each having a bending piece 54*c*, a swage piece 54*d*, a conductor swage piece 54*e*, and an outer-sheath swage piece 54*f* formed to be sequentially arranged from a base end part 54*a* side and bent inwardly at a right angle.

Next, assembling of the coaxial connector 100 formed of the contact 30, the body 40, and the shell 50 as described above and connection with the coaxial cable are described.

The contact 30 has the paired contact pieces 33 accommodated in the accommodation hole 41*c* of the body main structure 41, the coupling part 31 accommodated in the accommodating part 41*d* of the body main structure 41, and furthermore the connecting part 32 mounted and supported on the bottom plate part 42*a* of the body extension part 42, thereby being mounted on the body 40.

The body 40 with the contact 30 mounted thereon has the body main structure 41 accommodated and supported in the shell main body 51 and the body extension part 42 accommodated and supported in the shell extension part 52, thereby being mounted on the shell 50. Here, the paired projections 41*e* formed on the body main structure 41 fit in the paired notches 51*a* of the shell main body 51. Also, the bottom plate part 42*a* of the body extension part 42 is mounted on the paired support parts 52*b* of the shell extension part 52. Note that the elongated protrusion 42*d* formed on the lower surface of the bottom plate part 42*a* is positioned between the paired support parts 52*b* of the shell extension part 52 and the elongated protrusion 42*c* and the protrusion 42*e* are positioned between the paired support parts 52*b* and the shell main body 51.

Figure 5:
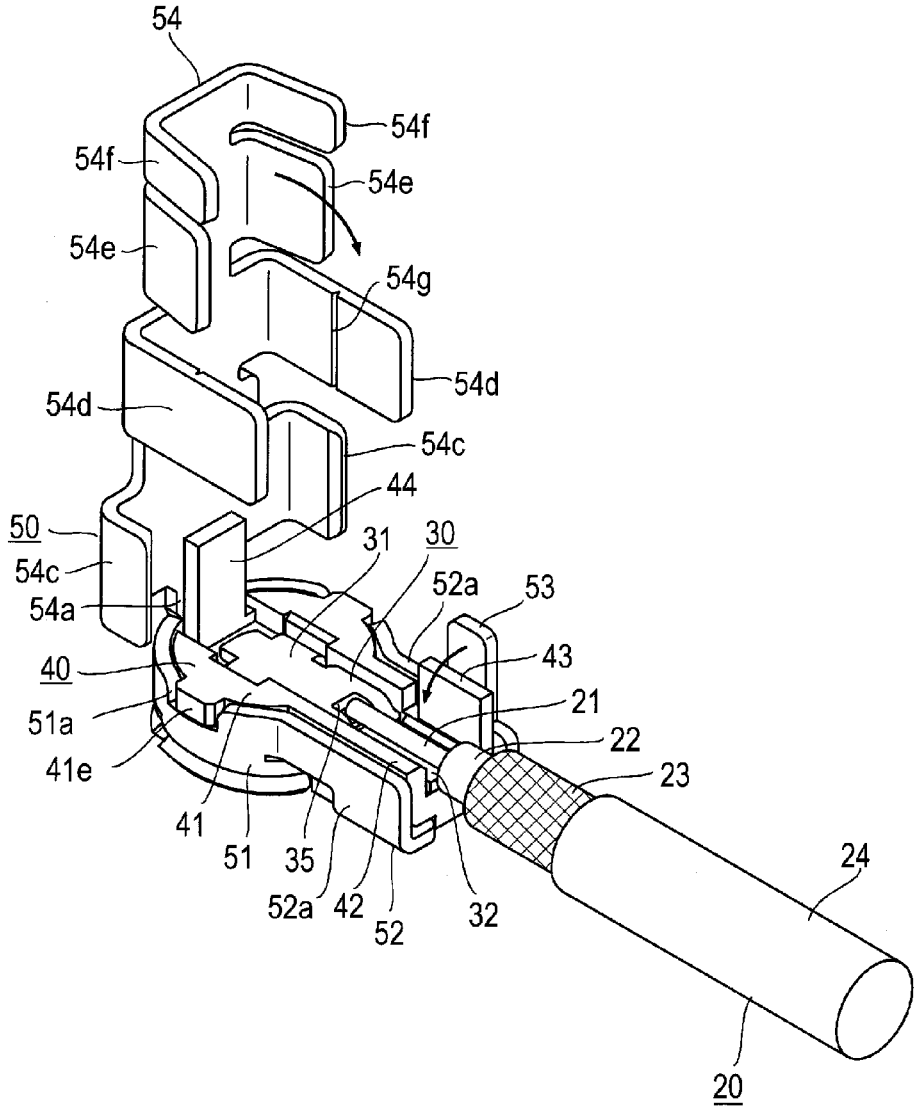
FIG. 5 is a drawing for describing an operation of connecting the coaxial cable to the coaxial connector depicted in FIG. 1A and FIG. 1B.

FIG. 5 depicts the state in which the contact 30 is mounted on the body 40 and the body 40 is mounted on the shell 50. In this state, the central conductor 21 of the coaxial cable 20 is placed on the connecting part 32 of the contact 30 as depicted in FIG. 5. Note that the central conductor 21 has its tip positioned in the positioning hole 35 of the contact 30. With this, the central conductor 21 is positioned.

With the central conductor 21 being positioned and placed on the connecting part 32 of the contact 30, the shell inner-lid part 53 is bent inwardly as indicated by an arrow. With the bending of the shell inner-lid part 53, the body inner-lid part 43 is also bent, and the central conductor 21 is interposed between the bent body inner-lid part 43 and the connecting part 32. With this, the central conductor 21 is pressed to be in contact with and electrically connected to the connecting part 32. Note that a V groove 53*a* (refer to FIG. 3) is formed in an inner surface at a lower end of the shell inner-lid part 53 so as to allow easy bending.

Next, the shell outer-lid part 54 is bent at its base end part 54*a* as indicated by an arrow. With this, the shell main body 51 and the shell extension part 52 have their upper surfaces covered with the shell outer-lid part 54, and the body 40 is covered with the shell 50. Note that the body bending part 44 is bent with bending of the shell outer-lid part 54, thereby being pressed to be in contact with the coupling part 31 of the contact 30. With this, a lift of the contact 30 is prevented.

The paired swage pieces 54*d* formed on the shell outer-lid part 54 are positioned at portions where the shell inner-lid part 53 and the body inner-lid part 43 are bent to connect the central conductor 21 of the coaxial cable 20 to the connecting part 32 of the contact 30. By swaging these swage pieces 54*d* as depicted in FIG. 1A, FIG. 1B, and FIG. 2, the circumference of the portion where the central conductor 21 is connected is firmly swaged, and the central conductor 21 is more reliably and stably connected and fixed to the connecting part 32. Note that a V groove 54*g* (refer to FIGS. 3 and 5) is formed in an inner side surface of each of the paired swage pieces 54*d* so as to allow easy swaging (bending) along the outer circumference of the shell extension part 52.

Furthermore, with the bending pieces 54*c* being bent so as to interpose the shell main body 51 in a diameter direction and the paired conductor swage pieces 54*e* and the paired outer-sheath swage pieces 54*f* each being swaged around the outer conductor 23 and the outer sheath 24, respectively, of the coaxial cable 20, the connection of the coaxial cable 20 to the coaxial connector 100 is completed and assembling of the coaxial connector 100 is also completed, resulting in the structure depicted in FIG. 1A, FIG. 1B, and FIG. 2. The structure is such that the upper surface of the bent shell inner-lid part 53 and the upper surface of the bent body bending part 44 are positioned on the same plane, and both are pressed to be in contact with the inner surface of the shell outer-lid part 54.

As described above, in this example, the central conductor 21 of the coaxial cable 20 is connected to the contact 30 not on the back side of the coupling part 31 where the contact pieces 33 of the contact 30 for the counterpart connector project but on the connecting part 32 formed to extend from the coupling part 31 and having a plate surface lowered (made lower) by one step from the coupling part 31 in a direction in which the contact pieces 33 project.

Figure 7:
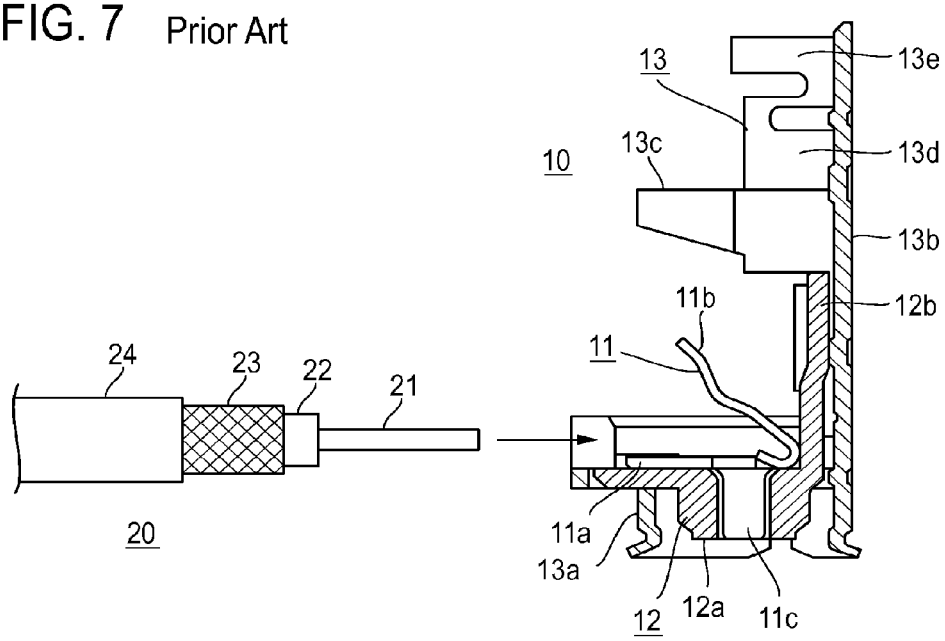
FIG. 7 Prior Art
FIG. 7 is a drawing for describing an operation of connecting a coaxial cable to a prior art coaxial connector.
Figure 8A:
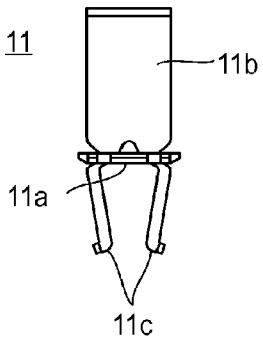
FIG. 8A Prior Art
FIG. 8A is a left side view of a connection terminal in FIG. 7.
Figure 8B:
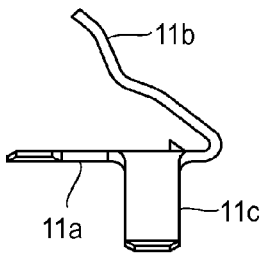
FIG. 8B Prior Art
FIG. 8B is a front view of the connection terminal in FIG. 7.
Figure 9:
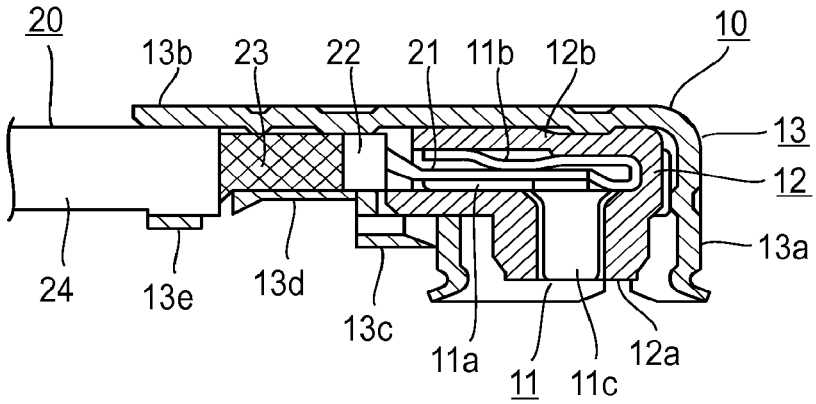
FIG. 9 Prior Art
FIG. 9 is a sectional view of the state in which the coaxial cable is connected to the coaxial connector depicted in FIG. 7.

Therefore, in comparison with a structure as in the prior art example depicted in FIG. 7 to FIG. 9 in which the central conductor of the coaxial cable is connected to the contact on the back surface of a portion where the contact pieces (the engaging tongue pieces) for the counterpart connector are positioned, a reduction in profile of the coaxial connector can be achieved.

In addition, since the central conductor 21 is interposed between the body inner-lid part 43 and the connecting part 32 of the contact 30 and is pressed to be in contact with the connecting part 32 for connection, a burdensome soldering operation is not required, and therefore the connecting operation can be simplified.

Note in this example that, as described above, since the connecting part 32 of the contact 30 to which the central conductor 21 is to be connected is positioned and mounted not on the body main structure 41 on which the contact pieces 33 for the counterpart connector are positioned but on the body extension part 42 formed to extend from the body main structure 41 and be shifted from the body main structure 41, the circumference of this portion where the central conductor 21 is to be connected to the connecting part 32, also including the body extension part 42, can be swaged by the swage pieces 54*d*. Therefore, the central conductor 21 can be more reliably connected and fixed to the contact 30.

In the structure as described above, the contact 30 and the shell 50 are made of a copper material, for example. Also, as a material resin of the body 40, PBT resin is used, for example. Since the body 40 is made of resin, for example, if the body bending part 44 provided to project on the body main structure 41 is long, a damage may occur during handling, transportation, and others in a manufacturing process. However, since this body bending part 44 is to prevent a lift of the contact 30, this part can be made as short as possible to the extent that a lift can be prevented.

While the body inner-lid part 43 for interposing and pressing the central conductor 21 of the coaxial cable 20 to the contact 30 is provided on one end edge of the body extension part 42 along the extending direction in the example described above, the body inner-lid part 43 may be provided on each of both end edges.

Figure 6:
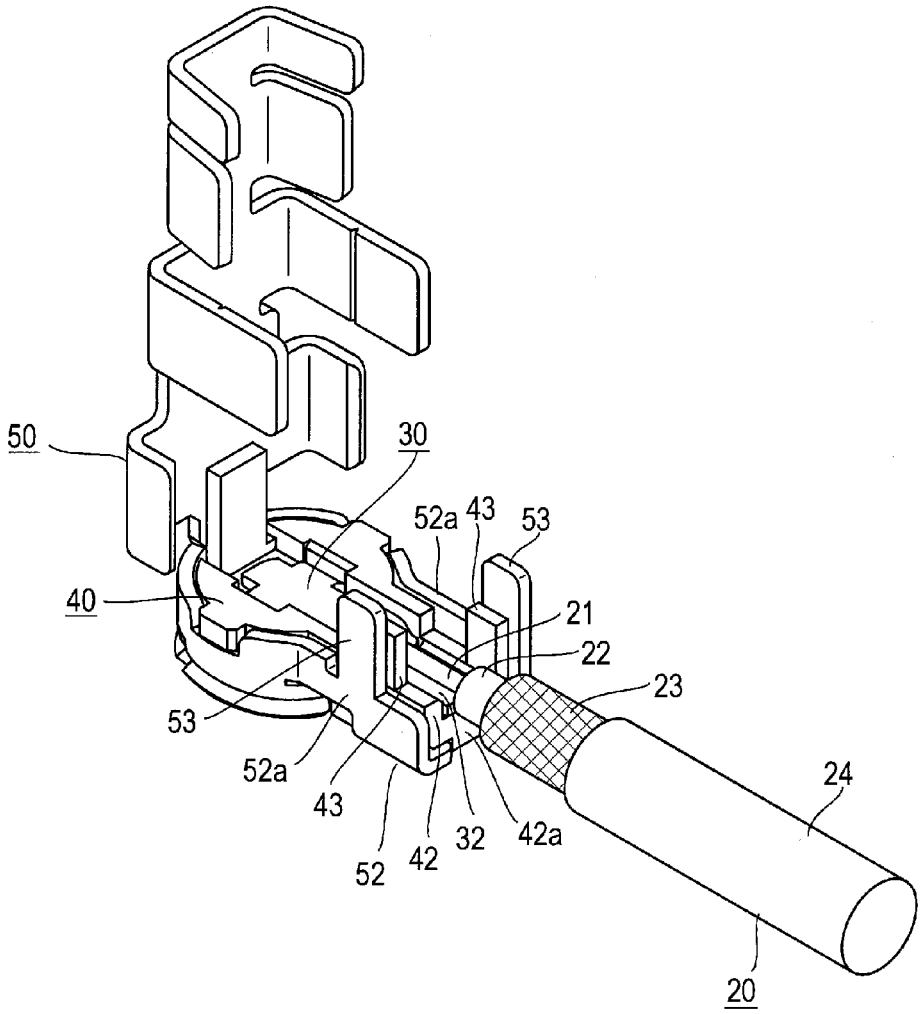
FIG. 6 is a drawing for describing a coaxial connector according to another embodiment of the present invention.

FIG. 6 depicts the structure as described above in which the body inner-lid part 43 is provided on each of both end edges of the body extension part 42. The paired body inner-lid parts 43 are alternately provided to project in the extending direction of the body extension part 42. The shell inner-lid part 53 is provided to project on each of both side walls 52*a* of the shell extension part 52 so as to correspond to the position of each of the body inner-lid part 43. The body 40 and the shell 50 may have this structure described above in place of the structure depicted in FIG. 3.

What is claimed is:

1. A coaxial connector comprising a contact to be connected to a central conductor of a coaxial cable, a resin-made body for accommodating the contact, and a metal-made shell for covering the body accommodating the contact, wherein the contact comprises a plate-shaped coupling part, paired contact pieces to be in contact with a counterpart connector, the paired contact pieces extending from two opposite side edges of the coupling part so as to face each other, and a connecting part formed to extend from another one side edge of the coupling part to support the central conductor, and the connecting part has a plate surface lowered by one step from a plate surface of the coupling part in a direction in which the contact pieces project, the body includes a body main structure having an accommodation hole for accommodating the paired contact pieces and an accommodating part for accommodating the coupling part, a body extension part formed to extend from the body main structure to have the connecting part mounted and supported thereon, and a body inner-lid part provided to project from at least one side end of the body extension part along an extending direction and to be bent on the connecting part, the shell includes a shell main body supporting the body main structure, a shell extension part formed to extend from the shell main body to support the body extension part, a shell inner-lid part provided to project from one side end of the shell extension part along an extending direction and to be bent on the body inner-lid part, and a shell outer-lid part provided to project on the shell main body and to be bent, the central conductor is configured to be interposed between the body inner-lid part bent with bending of the shell inner-lid part and the connecting part to be connected to the connecting part, the shell main body and the shell extension part are covered with the bent shell outer-lid part, and the shell outer-lid part is provided with swage pieces for swaging a circumference of a portion of the shell extension part to which the central conductor is to be connected.

2. The coaxial connector according to claim 1, wherein the shell outer-lid part is provided with conductor swage pieces and outer-sheath swage pieces that are swaged to an outer conductor and an outer sheath, respectively, of the coaxial cable.

3. The coaxial connector according to claim 1 or 2, wherein a body bending part to be bent with bending of the shell outer-lid part to be pressed to be in contact with the coupling part is provided to project on the body main structure.

4. The coaxial connector according to claim 1 or 2, wherein a positioning hole for positioning a tip of the central conductor is formed in the contact.

5. The coaxial connector according to claim 4, wherein the positioning hole is formed at a step part between the coupling part and the connecting part.

6. The coaxial connector according to claim 1 or 2, wherein another body inner-lid part is provided to project on another side end of the body extension part along the extending direction so that the body inner-lid part provided to project on the one side end and the other body inner-lid part are alternately provided along the extending direction, and another shell inner-lid part is provided to project on another side end of the shell extension part correspondingly to a position of the other body inner-lid part.

* * * * *